US007754653B2

(12) United States Patent
Hintz

(10) Patent No.: US 7,754,653 B2
(45) Date of Patent: Jul. 13, 2010

(54) METHOD FOR PREPARING SPRAYABLE FORMULATIONS OF MYCELIUM-BASED BIOLOGICAL CONTROL AGENTS PRODUCED BY SOLID STATE FERMENTATION

(75) Inventor: William Hintz, Victoria (CA)

(73) Assignee: University of Victoria Innovation and Development Corporation, Victoria, B. C. (CA)

( * ) Notice: Subject to any disclaimer, the term of this patent is extended or adjusted under 35 U.S.C. 154(b) by 982 days.

(21) Appl. No.: 10/286,884

(22) Filed: Nov. 4, 2002

(65) Prior Publication Data

US 2003/0103944 A1 Jun. 5, 2003

Related U.S. Application Data

(63) Continuation of application No. PCT/CA01/00583, filed on May 1, 2001.

(60) Provisional application No. 60/201,265, filed on May 2, 2000.

(51) Int. Cl.

| | |
|---|---|
| ***A01N 63/00*** | (2006.01) |
| ***A01N 63/04*** | (2006.01) |
| ***C12P 1/02*** | (2006.01) |
| ***C12N 1/00*** | (2006.01) |

(52) U.S. Cl. ..... 504/117; 424/93.5; 435/171; 435/254.1; 435/256.8

(58) Field of Classification Search ..... 504/117; 424/93.5; 435/171, 254.1, 256.8
See application file for complete search history.

(56) References Cited

U.S. PATENT DOCUMENTS

| | | | |
|---|---|---|---|
| 4,530,834 | A | 7/1985 | McCabe et al. |
| 5,185,255 | A | 2/1993 | Endo et al. |
| 5,360,607 | A | 11/1994 | Eyal et al. |
| 5,587,158 | A | 12/1996 | Wall et al. |
| 5,750,393 | A | 5/1998 | Torini |
| 6,197,573 | B1 | 3/2001 | Suryanarayan et al. |

FOREIGN PATENT DOCUMENTS

| | | | |
|---|---|---|---|
| CA | 2112438 | A1 | 6/1994 |
| DE | 238628 | A1 | 8/1986 |
| EP | 0191607 | A2 | 8/1986 |
| EP | 0605221 | A1 | 7/1994 |
| JP | 62234005 | A | 10/1987 |
| JP | 01037232 | A | 2/1989 |
| JP | 06247822 | A | 9/1994 |
| JP | 07258015 | A | 10/1995 |
| WO | WO 98/31220 | | 7/1998 |
| WO | WO 01/82704 | A2 | 11/2001 |
| WO | WO 01/82704 | A3 | 11/2001 |

OTHER PUBLICATIONS

Sato et al. "Small-Scale Solid-State Fermentations". In Demain and Davies, ed., Manual of Industrial Microbiology and Biotechnology, 2nd ed. 1999. p. 61-79.*

Carrier for Immobilised Soil Microorganism—Containing Porous Inorganic Powder Bio-Chemically Humidified Organic Material eg. Methyl Cellulose for Plant Growth Accelerate, Derwent Publications Ltd., London, GB; AN 1989-082866, XP 002183242.

Microbe Cel-Embedded Beads for Use in Medicine and Food etc. —Are Prepared by Using Polyvinyl Alcohol as Carrie, and a Gelling Agent, No Abstract, Derwent Publications Ltd., London, GB, AN 1987-329979, XP 002183244.

Microorganisms Containing Preparation for Agriculture Use—Is Obtained by Fixing Microorganisms to Polymer Material, Derwent Publications Ltd., London, GB, AN 1987-329979, XP 002183243.

PCT International Search Report, Jan. 5, 2001, 5 pages.

Shabana, Yasser M. et al., "An Evaluation of hydrophilic polymers for formulating the bioherbicide agents Alternaria cassiae and A. eichhorniae", Weed Technology, 1997, 212-220, vol. 11, No. 2, XP-002183241.

* cited by examiner

*Primary Examiner*—Alton N Pryor
(74) *Attorney, Agent, or Firm*—Klarquist Sparkman, LLP

(57) ABSTRACT

A sprayable pesticidal or herbicidal composition comprises inert carrier particles having supported thereon a fungal growth. The fungal growth comprises mycelium that is grown on the particles using a solid state fermentation process. The particles are provided in a dry state and can be suspended in a liquid carrier for spray application when needed. The invention also provides for a thickening agent that increases the viscosity of the spray solution so as to prevent sedimentation of the particles.

15 Claims, No Drawings

METHOD FOR PREPARING SPRAYABLE FORMULATIONS OF MYCELIUM-BASED BIOLOGICAL CONTROL AGENTS PRODUCED BY SOLID STATE FERMENTATION

This application is a continuation of PCT application number PCT/CA01/00583, filed May 1, 2001, which claims priority from U.S. application No. 60/201,265, filed May 2, 2000.

BACKGROUND OF THE INVENTION

1. Field of the Invention

The present invention relates to a method for preparing sprayable formulations of mycelium-based biological control agents produced by solid state fermentation. More specifically, the present invention relates to a method of production and use of mycelium-colonized particulate substrates in formulations that can be applied with conventional spray equipment. The invention also relates to compositions of sprayable formulations for delivering mycelium-based biological control agents to obtain maximum biological activity and viability.

2. Prior Art

Recent advances in biotechnology have resulted in significant increase in the use of microorganisms as biological control agents in agriculture, forestry, and environmental management. One group of microorganisms that has received particular attention in this area is fungi. A large number of fungi are known for their specific pathogenicity to weeds and insect pests, and many of them have been subjected to thorough scientific studies and commercial development as potential biological control agents. However, very few of these fungi have been commercialized successfully. In many cases, fungal-based biological control agents have failed to reach the market because of the lack of formulations to deliver the products effectively and economically.

As commercial products, biological control agents must be produced and sold in the ways that are more familiar to the end-user: the farmer, forester and environmental engineer. The two main criteria for a commercially viable fungi based product are:

1) that such products must be formulated to preserve maximum cell viability and biological activity under prolonged conditions of shipment and storage; and, 2) that such products must also be formulated and supplied to the end-user in a physical form that does not require new equipment, new technology or new application techniques.

Because the most common and effective application method used today is a spray that is applied with conventional equipment developed for agrochemicals, it is desirable to provide the biological control agents in similar sprayable formulations. For such a formulation, it is important that the biological control agent be provided in a generally uniform size and be dispersible in a liquid carrier so as not to clog sprayer nozzles. In this regard, fungi present a unique problem because of their filamentous structure known as mycelium.

Mycelium is a vegetative form in which a majority of fungal species grow and is very fragile and often varies greatly in sizes and shapes. Although mycelium can be easily produced by fermentation at commercial scale, it has proven difficult to process mycelium into sprayable formulations because of its fragile nature and uneven sizes. This formulation problem has become a major obstacle that blocks many mycelium-based biological control agents from reaching the market and from achieving successful commercialization.

In order to overcome the formulation problem associated with mycelium, several methods and processes have been disclosed in prior art. A simple method is the wet maceration of actively growing mycelium obtained from liquid culture. This method basically involves producing fungal mycelium by submerged fermentation, harvesting of the actively growing mycelium by filtration or centrifugation, reduction of mycelium particle size by high shear blending or milling prior to spray application. This method has been widely used in greenhouse and field experiments. For example, Wall et al. (U.S. Pat. No. 5,587,158) use this method for the application of *Chondrostereum purpureum*, a biological control fungus for weed trees. Despite its simplicity, the mechanical macerations drastically reduces the viability of the mycelium and often yields a formulation that has very low titer and short shelf life.

In another method, McCabe et al. (U.S. Pat. No. 4,530,834) disclose a dry grinding process for reducing the particle size of mycelium. In this reference, actively growing mycelium harvested from submerged fermentation is dried with protective agents, and then the dry mycelium mass obtained is milled to a form a powder. The dry powder preparation, when it is needed, can be re-wet, diluted in aqueous liquid and applied by spraying. Dried mycelium particles obtained from submerged fermentation of different fungi have been produced in similar ways by other investigators. In such cases, the mycelium obtained from submerged fermentation process is dried, ground in a hammer mill and passed through a sieve to obtain a desired particle size.

Although the dry mycelium powder has extended shelf-life and can be easily stored and handled, it again has a very low titer due to damage caused to the cellular structure of the mycelium by drying and milling.

In short, the prior art, as described above, teaches the use of actively growing mycelium produced by submerged fermentation, which has associated therewith the shortcomings of low titer or poor shelf life. As a result, there is a need for a stable, economical, mycelium-based formulation that can be applied with conventional spray equipment.

SUMMARY OF THE INVENTION

The present invention provides a method and process for preparing sprayable formulations of mycelium-based biological control agents produced by solid state fermentation using finely particulate substrates. In general, the process includes (a) growing a filamentous fungus by solid-state fermentation on the finely particulate substrate to achieve at least 50% of the particles being colonized by the fungal mycelium, (b) sieving the colonized particles to remove clumps larger than 1.0 mm; (c) dispersing the sieved particles in an amount of less than 5% by weight in a liquid carrier by high shear mixing; and (d)dispersing or dissolving a thickening agent in the mixture to create a viscosity that prevents the settling of particles.

Thus, the present invention provides, in one aspect, a sprayable composition comprising a particulate substrate colonized by mycelium of filamentous fungi and a liquid carrier.

In another aspect, the invention provides a process for preparing a sprayable formulation comprising a particulate substrate colonized by mycelium of filamentous fungi comprising the steps of:

a) growing filamentous fungi on the particulate substrate by solid-state fermentation;

b) processing the colonized particulate substrate to provide particles of a given diameter; and, c) dispersing the colonized particulate substrate of Step (b) in a liquid carrier.

In another aspect, the invention provides a pesticidal or herbicidal composition comprising:

a) inert carrier particles, said particles having supported thereon a fungal growth; and b) a liquid carrier.

DESCRIPTION OF THE PREFERRED EMBODIMENTS

The present invention provides a process for preparing a spray formulation comprising fungal mycelium produced by solid state fermentation. The formulation is particularly useful for delivering mycelium-based biological control agents using conventional spray equipment.

As is commonly known in the art, "solid state fermentation" generally refers to a process for fermenting microorganisms on a solid medium that provides a substrate for anchoring for fermenting microorganisms on a solid medium that provides a substrate for anchoring the microorganisms, in the absence of any feely flowing substance. The amount of water used in such a system can be varied as desired. Further, as is commonly understood, the term "solid" includes any medium ranging from one that is almost dry to one that is "slushy". The specific conditions will vary depending on the specific use and such conditions will be apparent to persons skilled in the art.

Although the present invention is preferably directed to fungi for use as biological control agents, it will be appreciated by persons skilled in the art that a variety of filamentous fungi having other applications such mushroom spawn, agriculture inoculants and remediation can also be used in the invention. Filamentous fungi useful for the purpose of this invention are preferably the species from the taxonomic groups as described by Ainsworth et al. in "the Fungi" (vol. 4a, b, Academic Press (1973). The major taxa, which contain filamentous fungi, are *Zygomycotina, Mastiogomycotina, Ascomycotina, Basidiomycotina*, and *Deuteromycotina.*

Mycelium of the filamentous fungi useful for this invention is preferably produced by solid state fermentation using a substrate that comprises a finely particulate material. The finely particulate substrates used in this invention provide the following advantages that allow mycelium produced by the solid state fermentation to be conveniently incorporated into spray formulation:

(a) they act as carriers for fungal mycelium; and (b) they act as a protectant for preventing damage to the mycelium cause by grinding, blending, sieving or high shear mixing during downstream formulation process and by dehydration and oxidation during storage.

Finely particulate substances suitable in the present invention are water-dispersible, non-toxic, polymeric materials that have a particle size between 0.01 mm to 1.0 mm. The polymeric materials can be either synthetic or of natural origin. Preferable natural materials useful for this invention include, but are not limited to, finely ground peat and microcrystalline cellulose (e.g. Avicel™). Preferable synthetic materials useful for this invention include, but are not limited to, micro-sized beads made from polyvinyl alcohol and polyethylene.

As indicated above, solid state fermentation for production of mycelium useful in this invention can be conducted with variety of methods that are well known in the art. Generally, an inoculum of the preferred fungi may be prepared by a standard surface culture on agar slant, and the agar content then used to inoculate shake flasks containing either liquid medium or solid substrate under standard conditions. After incubation, the biomass obtained from the shake flasks is used to inoculate the fermentation vessel containing solid substrate, which, for the purposes of the present invention, are finely particulate substrate beads that have been pre-wetted with liquid nutrient and sterilized by either autoclaving or irradiation. In the preferred embodiment, the fermentation is conducted in such a way that the finely particulate substrate is predominately colonized by fungal mycelium; that is, at least about 50 % of the particles are colonized by mycelium. This can be achieved by mixing the content in the fermenter by low shear mixing or other means that allow the dispersion of the inoculum and colonized particles during the fermentation.

In order to produce mycelium that are more stable, the moisture content of the fermentation substrate should be maintained at between 10 to 30% (w/w) depending on the water retaining capacity of the substrate. Preferably, the moisture level should not create "water logged" conditions or obstruct the flowability of the particulate substrate in the vessel.

In order to increase the yield of mycelium and the colonization of particles, the fermentation substrate and nutrition medium should preferably be adjusted to a pH of approximately 4 to 7. Adjustment and control of the pH values can be achieved by the addition of an organic or inorganic acid or base as necessary and in a manner that will be apparent to persons skilled in the art.

Other fermentation parameters such as aeration and temperature are ordinarily employed conditions that can also be easily applied and varied in this invention by those skilled in the art.

The duration of the fermentation process will vary depending on such factors as, for example, the particular species of the fungi used, the nutrients being added, and the type of fermentation vessel used. Typically, one to four weeks of fermentation will be sufficient. The end of the fermentation can be easily determined by a standard biomass determination (e.g. dry weight), colony forming unit determination, or microscopic observation. Other tests or methods may be utilized as needed to determine when sufficient fermentation has been achieved.

At the end of the fermentation, the particulate substrate, having on its surface, the mycelium from the fermentation step is unloaded from the fermentation vessel to a high shear blender to break up clumps. The comminuted material is then passed through a sieve to remove large clumps. In the preferred embodiment, the sieve is used to remove clumps larger than 1.0 mm; however, it will be apparent to persons skilled in the art that various other sizes of particles may be acceptable depending upon the final application machinery.

The final product so obtained is a flowable powder that comprises, preferably, mycelium-colonized particles smaller than 1.0 mm in size. The flowable powder can be packaged in sealed containers or bags and stored under room temperature or refrigeration or freezing conditions until use. The mycelium so prepared retains high biological activity and viability on the shelf. For, example, the mycelium of *Chondrostereum purpureum*, a biological control agent for weed trees, produced according to the method of the present invention can be stored at room temperature for over a year without significant loss of biological activity and viability.

The spray formulation composition disclosed in the present invention comprises, basically, the mycelium colonized particulate substrate and a liquid carrier. The formulations can be prepared by methods known to these skilled in the art. Preferably, the mycelium colonized particulate substrate is first added to the liquid carrier and dispersed completely by high shear mixing (e.g. 500 rpm or higher).

Liquid carriers useful in this invention include aqueous, organic or non-organic based liquid solutions that are not toxic to fungi and the environment. Preferred liquid carriers are water and, more preferred are emulsions with water as the continuous phase (i.e. an oil in water emulsions). When a complex liquid carrier such as an emulsion, is used, compatibility between the liquid and the particulate substrate should be tested before the formulation process. The test can be simply done by mixing the two components together and examine if the particulate substrate causes phase separation of the emulsion.

In the preferred embodiment, a thickening agent can be added to increase the viscosity of liquid carrier so that the particulate substrate in the mixture does not settle, even in the case of a solution that remains stagnant. However, it will be understood that the need for a thickening agent may be avoided if the liquid carrier is capable of achieving the same result as indicated above. Further, if a constant mixing apparatus is provided, then the need for a thickening agent can be avoided.

The use of a thickening agent in the formulation of the invention is to prevent the particulate substrates from settling during application without the need of continuing mixing or agitation. Thickening agents useful in this inventions are gelling agents derived either from synthetic or natural sources. Preferably, the gelling agents used in this invention are water-dispersible gelling clay including, but not limited to, attapulgite, sepiolite and bentonite, and the water-soluble polymers including, but not limited to, starch, alginates, carboxymethylcellulose, and polyethylene glycol.

The resulting formulations should be stable for at least 24 hours and can be used with conventional spray equipment including the low pressure sprayers such as back pack sprayers and high speed atomizers. Preferably, the formulations of the invention include solid particle sizes that can be delivered via nozzle or nozzles that are normally used for spraying other compositions of a liquid containing solid particles. It will be understood, that the sprayability of the formulation of the invention can be achieved by either tailoring the particle size to a given nozzle or by forming a nozzle to a give particle size.

The amounts of the particulate substrate used in the spray formulations is preferably in the range of 0.01% to 5% of the formulation, by weight, in order to maintain the fluidity of the formulations and to facilitate the spraying application.

Other additives such as dyes, nutrients and surfactants can also be added to the formulations as long as the addition materials do no obstruct the integrity of the formulations and the biological activity of the fungal mycelium.

As described above, the present invention provides improved biological control products using filamentous fungi as the active control agents. In the preferred embodiment, the fungi are grown using solid state fermentation, which enhances the growth of a variety of fungal species. Such species includes those that may not grow well or even survive in submerged fermentation systems. In addition, the solid state fermentation used in the invention also offers a simple, economic and energy saving method for large-scale production of fungal mycelium.

In another aspect, the use of fine particulate substrates in this invention provides a new approach that allows mycelium produced by solid state fermentation to be conveniently incorporated into sprayable formulations. The finely particulate substrates used in this invention act as a carrier for fungal mycelium and as a protection means for preventing damage to the mycelium during downstream processing. Therefore, the problems of low titer and poor shelf life of the mycelium formulations that have often seen in prior art can be solved by the present invention.

By way of example, the following fungal strains and substrates are provided for use with the present invention:

| Fungal Strain | Solid Substrate Particles |
|---|---|
| *Chondrostereum purpureum* | peat powder and Avicel ™ |
| *Alternaria cassiae* | peat powder and Avicel ™ |
| *Beauveria bassiana* | peat powder and Avicel ™ |
| *Chondrostereum purpureum* | peat, water and clay |
| *Chondrostereum purpureum* | peat, emulsion and clay |

The following examples are provided to illustrate the present invention and are not intended to be limit the invention in any way.

EXAMPLE 1

Result documented in this paper provide data that support the use of the peat-based substrate colonized by the fungal mycelium, as well as efficacy data from field trials of the biocontrol agent that have used the paste formulation made with the peat-based formulation.

Materials and Methods

The solid substrate inoculum is produced by a two-stage fermentation process. A malt extract based broth (malt extract 15 g/l, sucrose 5 g/l, peptone 2 g/l, polyethylene glycol 3000 0.5 g/l, thiamine 2 mg/l and $K_2HPO_4$ 1 g/l), contained in a 10 L fermenter, was inoculated with a blended liquid culture *C. purpureum* mycelium. A high rate of agitation and aeration produces a liquid *C purpureum* culture with a large number of small mycelial fragments of high viability and titer. This liquid culture is diluted in a malt extract broth and provides an ideal inoculum for a peat-based substrate, contained in sterile bags (400 ml inoculum into each 1 kg bag of sterile milled peat). Solid matrix fermentation proceeds at room temperature (22-26° C.) for 4 to 6 weeks to allow adequate colonization of the substrate and this uniform material is subsequently used as the active ingredient in the spray formulation. Quality control at all stages of this manufacturing process is important in detecting the occurrence of microbial contaminants and identifying sources of contamination. The substrate must be free of human and animal pathogens and may contain no more than $1\times10^2$ cfus $kg^{-1}$ of microbial contaminants. Contaminants will reduce the titer of the substrate and may include organisms that pose a risk to worker health, or non-target species. As well, quality control is essential in monitoring the titer of inoculum.

Measurement of substrate titer is a measure of inoculum potential of the colonized substrate. For out work with *C. purpureum*, solid state fermentation must achieve a minimum titer of $1\times10^7$ cfu/kg to be acceptable for field use. To determine inoculum titer, samples of solid substrate were taken at several intervals after initial substrate inoculation (4 weeks to 12 months). Titer was determined from three separate samples of 10 g solid substrate. A homogeneous suspension of the sample in sterile water further diluted ($10^{-2}$, $10^{-3}$ and $10^{-4}$ grams substrate/ml sterile water) and 1 ml suspensions of each dilution were plated (3 plates/sample dilution) onto malt extract agar and 2YT agar plates, for cfu count determination (incubation at 25° C.) and the detection of contaminants (incubation at 37° C.), respectively. Plates were evaluated after several days of growth.

Results

Upon completion of the solid matrix fermentation, the titer of the active ingredient is well above the minimum standard of $1\times10^7$ cfus $kg^{-1}$ (Table 1). When stored at room temperature (22-26° C.), this minimum standard is maintained for at least twelve months, for a longer period than the clay-based substrate.

TABLE 1

Titer and long-term storage of peat- and clay-based active ingredients.

| Active ingredient | Titer over time (cfus $kg^{-1}$)[a] 4 weeks | 4 months | 8 months | 12 months |
|---|---|---|---|---|
| Peat-based | 1.4 to 4.4 × $10^8$ | 1.1 to 4.4 × $10^8$ | 4.7 × $10^7$ to 3.5 × $10^8$ | 1.5 × $10^7$ to 1.2 × $10^8$ |
| Clay-based | 1.5 to 2.5 × $10^8$ | 1.9 to 7.3 × $10^7$ | 1.3 to 3.2 × $10^7$ | 5.8 to 7.7 × $10^6$ |

[a]Range of titers determined by cfu assays of independent samples taken from five separate batches each of clay- and peat-based inoculum over time.

The peat-based substrate has proven to be of consistently high purity and maintains the pathogenicity of the fungus for the target hosts (Table 2). Field assessments of efficacy used the peat-based substrate as the active ingredient in the paste formulation and showed a level of efficacy similar to the paste containing the clay-based substrate. The peat-based substrate can be used as the active ingredient in different formulations of the biocontrol agent as required, and can also be easily transported in dry form, prior to mixing with the other ingredients of a formulation.

TABLE 2

Comparative efficacy of peat- and clay-based formulations.

| Formulation | Re-isolation of fungus from stumps[a] | Efficacy in 1999 % coppices with no re-sprouting | Efficacy in 2000 % coppices with no re-sprouting | Titer of EUP (cfus $g^{-1}$)[b] |
|---|---|---|---|---|
| Peat paste (1x) | Yes | 90 | 78 | 1 × $10^2$ |
| Peat paste (0.5x) | Yes | 95 | 94 | 0.5 × $10^2$ |
| Peat paste (0.25x) | Yes | 81 | 93 | 0.25 × $10^2$ |
| Clay paste | Yes | 85 | 75 | 1 × $10^2$ |
| Untreated control | N.A. | 40 | 22 | N.A. |

[a]Identified by PCR-based genetic markers (Becker, Ball and Hintz, 1999).
[b]Minimum estimated titer of EUP.

Summary

We evaluated the long-term shelf life of the peat-based solid substrate inoculum to be used in the spray formulation. The peat-based substrate maintained a sufficiently high level of titer (above the acceptable limit for use in a spray formulation) for a period of at least one year, when stored at room temperature (Table 1). These results show that the peat-based substrate is superior to the clay-based substrate for long-term storage of a high titer substrate. As well, it may be stored at room temperature, while the clay-based substrate requires storage at 4 C.

II. Evaluation of Other Fungal Species on the Peat-based Substrate

We are currently evaluating the peat-based substrate as the active ingredient for a spay for formulations to be used for the application of mycelial fragments and spores of other species of mycelial fungi. These species are all saprophytic basidiomycete fungi that are known to colonize and degrade non-living woody, or lignin-containing substrates. There are two elements to this work. We are first determining if these species will grow well on the peat-based substrate, using a similar two-stage fermentation process, and provide a high titer inoculum. The second step is to evaluate the utility of this inoculum in the spray formulation, to be applied to a wood fragment substrate for the purpose of pitch control in the manufacture of paper products from wood pulp.

Materials and Methods

Cultures were inoculated onto plates containing complete yeast medium (CYM) agar and incubated at 25° C. Two-week-old plate cultures were used as inoculum for liquid cultures in CYM (contains dextrose 20 g/l, peptone 2 g/l, yeast extract 2 g/l, $MgSO_47H_2O$ 0.5 g/l, $KH_2PO_4$ 0.46 g/l. $K_2HPO_4$ 1.0 g/l, and bacto agar 15 g/lm for plates only). Colonies were cut out of plates and blended in liquid medium (50 mL) at maximum speed for 10 seconds in a Waring blender. A volume of 10-mL mycelial slurry was used to inoculate 500-mL flasks containing 100mL liquid CYM, with 3 flasks inoculated for each isolate of fungus. Liquid cultures were incubated as static cultures at 25° C. for 10 days. After this interval, two 100-mL volume cultures were blended at maximum speed in a Waring blender for 10 seconds. The resulting slurry was mixed with an equal volume of fresh liquid CYM and this suspension (400-mL volume) was then used as inoculum for a plastic bag containing 1 kg of dry, sterile, finely milled peat.

Inoculated bags were incubated at 25° C. for 2 months and then evaluated for several variables. These included substrate colour, texture and fragment size, flowability of the colonized peat substrate, titer of colonized inoculum (colony forming units, or cfu/g substrate) and ease mixing in water. Samples of 25 g were taken from the bags and evaluated for the above variables. The ease of mixing was determined by taking a 4 g sample of substrate and mixing it for one minute in 1 liter of distilled water at high speed, in a 2-liter flask containing a stir bar for mixing. A concentration of 4 g/liter of substrate was used, since this was the favoured concentration of peat-based active ingredient in our spray formulation for *Chondrostereum purpureum*.

Measurement of substrate titer is a measure of inoculum potential of the colonized substrate. For our work with *C. purpurpeum*, solid state fermentation must achieve a minimum titer of $1\times10^7$ cfu/kg to be acceptable for field use. In addition, contamination of the substrate by other microorganisms is determined at this time. For our purposes, it must be free of animal and human pathogens and the level of other contaminants must not exceed $1\times10^2$ cfu/kg.

To determine inoculum titer, samples of solid substrate were taken 2 months after initial substrate inoculation. For each fungal strain, titer was determined from three separate samples of 10 g solid substrate. A homogeneous suspension of the sample in sterile water was further diluted ($10^{-2}$, $10^{-3}$ and $10^{-4}$ grams substrate/ml sterile water and 1 ml suspensions of each dilution were plated (3 plates/sample dilution) and the detection of contaminants (incubation at 37° C.), respectively. Plates were evaluated after several days of growth.

Results

Summarized in Table 3. The substrate showed signs of colonization by all four isolates in the form of small, dispersed white clumps of mycelium, about 1 mm in diameter, as well as in different degrees of clumping of the fine substrate. However, colonization was most apparent with isolate A578. This isolate formed larger clumps of substrate that were observed to contain a network of mycelium when broken up.

It formed the least flowable substrate and required more effort to break up manually, or by mixing in water. This isolate may therefore require some milling before use in a spray preparation. The three other isolates formed a more flowable substrate that also mixed more easily in water.

TABLE 3

Summary of observations for growth on solid substrate.

| Variable | Fungal isolates[1] A578 | A588 | A660 | A661 |
|---|---|---|---|---|
| Colour of substrate | Pale brown | Brown | Brown | Brown |
| Texture and fragment size of substrate | Much clumping with many larger fragments (0.5 to 1.0 cm diameter) | Moderate clumping with most fragments less than 0.5 cm diameter | Moderate clumping with most fragments less than 0.5 cm diameter | Very little clumping with most fragments less than 0.3 cm diameter |
| Flowability of substrate | Requires the most effort to be broken into smaller fragments | Needs to be broken into smaller fragments | Needs to be broken into smaller fragments | Most flowable isolate |
| Ease of mixing in distilled water | Some smaller clumps still visible in suspension | Fine, uniform fragments in suspension | Fine, uniform fragments in suspension | Fine, uniform fragments in suspension |
| Titer of solid substrate (cfus/kg)[2] | $2.98 \times 10^8$ | $2.92\text{-}3.2 \times 10^7$ | $6.5\text{-}6.6 \times 10^7$ | $1.82 \times 10^8$ |
| Contaminants in solid substrate | None detected | None detected | Yeast-like growth on $10^{-2}$ and $10^{-3}$ dilutions | None detected |

[1]*Bjerkandera adusta* (IJFM A660), *Phlebia radiata* (IJFM A588), *Pleurotus pulmonarius* (IJFM A578), and *Poria subvermispora* (IJFM A661).
[2]Number of colony forming units (cfus) per kilogram of solid peat inoculum.

The titer of each of the inoculated substrates is the best measure of the extent of colonization and gives a relative measure of the utility of this culture system for the species tested. Titer values among the four strains range from about $3.0\times10^7$ to $3.0\times10^8$ cfus/kg. The estimated titer values are above the acceptable range fro the production of solid substrate inoculum (a minimum titer of $1\times10^7$ cfus/kg).

Summary

This peat-based solid substrate, colonized by any of these species, should therefore be suitable for use as the active ingredient in a spray formulation. This demonstrates that species other than *C. purpureum* can be cultured in this system.

The next step of this study will involve the small-scale testing of a spray formulation on wood fragments to determine if the peat-based substrate provides an effective source of fungal inoculum for wood colonization by these species. This formulation will be applies to a wood substrate that requires treatment for pitch degradation. The fungal species tested have been selected for their superior abilities to degrade pitch deposits, that occur in paper mills. Pitch includes a large group of wood-derived compound, soluble in organic solvents, that are also referred to as wood extractives; these substances can collect on mill equipment, may contribute to waste water toxicity and often cause important economic losses in paper mills. The use of these fungi is seen as biological approach to this problem. The peat-based inoculum and spray formulation technology we have been developing may well be useful for this application, which differs from the original use of this technology in biocontrol agent inoculation.

Although the invention has been described with reference to certain specific embodiments, various modifications thereof will be apparent to those skilled in the art without departing from the spirit and scope of the invention as outlined in the claims appended hereto.

What is claimed is:

1. A composition for the preparation of a sprayable formulation, said composition comprising:

a flowable substrate dispersed in water; and bentonite clay, wherein the flowable substrate consists of particles 0.01 mm to 1.0 mm in diameter, the particles comprising a finely particulate substrate comprising peat powder colonized by viable mycelium of *Chondrostereum purpureum*, and wherein viability of the mycelium colonized particles is retained for over a year at room temperature.

2. The composition of claim 1, wherein said viable mycelium has a titer of at least about $1\times10^7$ cfus/kg.

3. The composition of claim 1 wherein said particulate substrate further comprises crystalline cellulose.

4. The composition of claim 1, wherein the bentonite clay comprises less than 10% of said composition.

5. The composition of claim 1, wherein the bentonite clay comprises less than 20% of said composition.

6. The composition of claim 1, wherein said flowable substrate comprises less than 5% by weight of said composition.

7. The composition of claim 1, wherein said finely particulate substrate comprises 0.01 to 5% by weight of said composition.

8. A process for preparing a sprayable formulation, comprising:

a) colonizing a finely particulate substrate comprising peat powder with *Chondrostereum purpureum* by solid-state fermentation, thereby providing a mycelium colonized finely particulate substrate;

b) processing the mycelium colonized finely particulate substrate to provide a flowable substrate, the flowable substrate consisting of particles smaller than 1.0 mm in diameter, c) dispersing said flowable substrate in water, and d) dispersing or dissolving bentonite clay into the water thereby providing a sprayable formulation, wherein viability of said mycelium colonized finely particulate substrate is retained for over a year at room temperature.

9. The process of claim 8 wherein the fermentation is followed to achieve at least 50% of the finely particulate substrate being colonized by the *Chondrostereum purpureum* mycelium.

10. The process of claim 8 wherein said finely particulate substrate comprises less than 5% by weight of said formulation.

11. The process of claim 10 wherein said particulate substrate further comprises crystalline cellulose.

12. The process of claim 8, wherein the bentonite clay comprises less than 10% of said formulation.

13. The process of claim 8 wherein the bentonite clay comprises less than 20% of said formulation.

14. The process of claim 8 wherein high speed shearing is used to disperse the flowable substrate in the water.

15. The process of claim 8, wherein the mycelium colonized substrate has a titer of at least $1\times10^7$ cfus/kg.

* * * * *

UNITED STATES PATENT AND TRADEMARK OFFICE

CERTIFICATE OF CORRECTION

PATENT NO. : 7,754,653 B2
APPLICATION NO. : 10/286884
DATED : July 13, 2010
INVENTOR(S) : William Hintz It is certified that error appears in the above-identified patent and that said Letters Patent is hereby corrected as shown below:

On the Title Page:

Under Item (56), Other Publications, line 9, in the third listed citation, "Carrie" should be --Carrier--.

In the Specification:

Column 2, line 24, "to a form a" should be --to form a--.

Column 2, line 51, "mycelium, (b)" should be --mycelium; (b)--.

Column 2, line 55, "(d)dispersing" should be --(d) dispersing--.

Column 3, lines 22-23, "for fermenting microorganisms on a solid medium that provides a substrate for anchoring" should be deleted.

Column 3, line 24, "feely" should be --freely--.

Column 3, line 34, "such mushroom" should be --such as mushroom--.

Column 3, line 39, "(1973)." should be --(1973)).--.

Column 3, line 51, "cause by grinding" should be --caused by grinding--.

Column 3, line 52, "formulation process" should be --formulation processes--.

Column 3, lines 65-66, "with variety" should be --with a variety--.

Column 4, line 59, "For, example," should be --For example,--.

Signed and Sealed this
Nineteenth Day of June, 2012

David J. Kappos

David J. Kappos
*Director of the United States Patent and Trademark Office*

Column 4, line 67, “these” should be --those--.

Column 5, line 8, “i.e. an oil” should be --i.e. oil--.

Column 5, line 13, “examine if” should be --examining if--.

Column 5, line 16, “of liquid” should be --of the liquid--.

Column 5, line 30, “clay” should be --clays--.

Column 5, line 39, “via nozzle” should be --via a nozzle--.

Column 5, line 43, “give” should be --given--.

Column 6, line 3, “often seen” should be --often been seen--.

Column 6, line 18, “not intended to be limit” should be --not intended to limit--.

Column 6, line 23, “Result” should be --Results--.

Column 6, line 35, “C” should be --C.--.

Column 6, line 43, “in the spray” should be --in the paste or spray--.

Column 6, line 54, “out” should be --our--.

Column 7, line 61, “4C” should be --4°C--.

Column 7, line 62, “II. Evaluation” should be --Evaluation--.

Column 8, line 15, “g/l.” should be --g/l,--.

Column 8, line 16, “g/lm” should be --g/l--.

Column 8, line 26, “(400-mL volume)” should be --(400-mL total volume)--.

Column 8, line 55, “water and” should be --water) and--.

Column 8, lines 56-57, “dilution) and the” should be --dilution) onto malt extract agar and 2YT agar plates, for cfu count determination (incubation at 25°C) and the--.

Column 9, line 40, “fro” should be --for--.

Column 9, line 53, “applies” should be --applied--.

Column 9, line 57, “compound” should be --compounds--.

Column 9, lines 62-63, “as biological” should be --as a biological--.

In the Claims:

Column 10, line 49, claim 2, “least about $1\times10^7$” should be --least $1\times10^7$--.

Column 11, line 6, claim 8, “water” should be --water,--.